US005813565A

United States Patent [19]

Huot

[11] Patent Number: 5,813,565

[45] **Date of Patent: *Sep. 29, 1998**

[54] PROCESS FOR THE PRODUCTION OF METALLIC PACKAGING OF GENERALLY PRISMATIC SHAPE AND PACKAGING OBTAINED BY THIS PROCESS

[75] Inventor: Gerald Huot, Verneuil-sur-Avre, France

[73] Assignee: Safet Embamet, Villeneuve-La-Garenne, France

[ * ] Notice: This patent issued on a continued prosecution application filed under 37 CFR 1.53(d), and is subject to the twenty year patent term provisions of 35 U.S.C. 154(a)(2).

[21] Appl. No.: 596,659

[22] Filed: Feb. 5, 1996

[30] Foreign Application Priority Data

Feb. 3, 1995 [FR] France ..... 95 01292

[51] Int. Cl.[6] ..... B21D 6/28; B65D 6/38; B65D 11/10

[52] U.S. Cl. ..... 220/619; 72/379.4; 220/669

[58] Field of Search ..... 220/619, 612, 220/656, 657, 658, 659, 669, 678, 8, 4.01, 680, 784, 780; 72/379.2, 379.4, 701

[56] References Cited

U.S. PATENT DOCUMENTS

| | | | |
|---|---|---|---|
| 1,316,237 | 9/1919 | Hodgson | 220/619 |
| 1,645,971 | 10/1927 | Riegel | 220/669 X |
| 2,071,602 | 2/1937 | Rheem | 220/619 X |
| 2,114,137 | 4/1938 | Conner . | |
| 2,153,365 | 4/1939 | Conner | 220/669 X |
| 2,596,043 | 5/1952 | Piker | 220/669 X |
| 3,157,308 | 11/1964 | Foster | 220/669 |
| 3,953,994 | 5/1976 | Brawner et al. . | |
| 4,113,095 | 9/1978 | Dietz et al. | 220/669 X |

FOREIGN PATENT DOCUMENTS

| | | |
|---|---|---|
| 393 240 | 9/1991 | Austria . |
| 0 448 436 | 9/1991 | European Pat. Off. . |

*Primary Examiner*—Allan N. Shoap
*Assistant Examiner*—Niki M. Kopsidas
*Attorney, Agent, or Firm*—Young & Thompson

[57] ABSTRACT

According to this process, a tubular metal body (10) of substantially polygonal cross-section is formed, delimiting lateral faces (12) of the package which are connected together by rounded corners (14). Then a radially projecting metal-expansion bead (18) is formed in proximity to a first end of the body (10) and in each of the corners of this body. The beads (18) are all substantially the same distance from this first end. Finally, a neck (20) and a flange (22) extending this neck are formed on the first end of the body (10), and a detached metal face (24) forming a bottom or a top of the package is seamed onto the flange (22).

18 Claims, 4 Drawing Sheets

PROCESS FOR THE PRODUCTION OF METALLIC PACKAGING OF GENERALLY PRISMATIC SHAPE AND PACKAGING OBTAINED BY THIS PROCESS

The present invention relates on the one hand to a process for fabricating a metal package of overall prismatic shape and on the other hand to a metal package obtained by this process.

The state of the art already discloses a process for fabricating a metal package of overall prismatic shape, of the type in which a tubular metal body of substantially polygonal cross-section is formed, delimiting lateral faces of the package which are connected together by rounded corners.

Such a tubular body is obtained in a manner known per se, for example:

by cutting a sheet metal blank, rolling this blank so as to form a cylinder, welding the longitudinal joining edges of the cylinder, especially with the aid of electrical welding means, so as to obtain a metal sleeve, and impressing a substantially polygonal cross-section, (with rounded corners), for example rectangular, on this sleeve with the aid of expansion means.

It is also known to form a flange on one end of the tubular body so as to be able to seam onto this flange a detached metal face forming a top or bottom of the package.

However, the rounded parts of the flange thus formed, corresponding to the rounded corners of the body, exhibit a deficit of metal as compared with the straight parts of the flange.

Despite this deficit of metal, the detached face can be seamed onto the flange in a relatively satisfactory manner.

Such would not be the case if it was required to seam the detached face onto a neck made in the end of the polygonal tubular body. Indeed, in this event, the rounded parts of the neck, corresponding to the rounded corners of the body, exhibit a surplus of metal as compared with the straight parts of this neck.

The forming of a flange extending the neck causes the accumulation of defects related to the neck (surplus of metal in the rounded corners) and to the flange (deficit of metal in the rounded corners).

The two types of defect do not offset one another given that the surplus of metal due to the neck is proportionally much greater than the deficit of metal due to the flange.

Consequently, a flange formed on a neck made in the end of a tubular body of substantially polygonal cross-section exhibits a very irregular outline unsuited to the seaming of a detached face onto the flange.

The purpose of the invention is to remedy the defects occurring during the formation of a flange on a neck made in a tubular body of substantially polygonal cross-section.

For this purpose, the subject of the invention is a process for fabricating a metal package, of the aforesaid type, characterized in that:

a radially projecting metal-expansion bead is formed in proximity to a first end of the body and in each of the corners of this body, the beads all being substantially the same distance from this first end, a neck and a flange extending this neck are formed on the first end of the body, and a detached metal face forming a bottom or a top of the package is seamed onto the flange.

According to other characteristics of this process:

the beads are formed so as to run radially outwards from the body;

the neck is formed so as to be connected to the rest of the body by an inclined linking part spaced axially a distance of between 0 and 3 mm from the beads;

a flange is formed on the second end of the body, opposite to the first end, and another detached metal face forming a top or a bottom of the package is seamed onto this flange.

The subject of the invention is also a metal package of overall prismatic shape, of the type including a tubular metal body of substantially polygonal cross-section delimiting lateral faces of the package which are connected together by rounded corners, and a face forming a top or bottom of the package seamed onto one end of the body, characterized in that the face forming a top or bottom is seamed onto a neck made in the corresponding end of the body.

According to other characteristics of this package:

it moreover includes a radially projecting metal-expansion bead made in each of the corners of the body, the beads all being substantially the same distance from the neck;

the beads run radially outwards from the body;

the neck is connected to the rest of the body by an inclined linking part spaced axially a distance of between 0 and 3 mm from the beads.

The invention will be better understood on reading the description which follows given merely by way of example for the comprehension of which reference will be made to the appended drawings in which.

Figure 1:
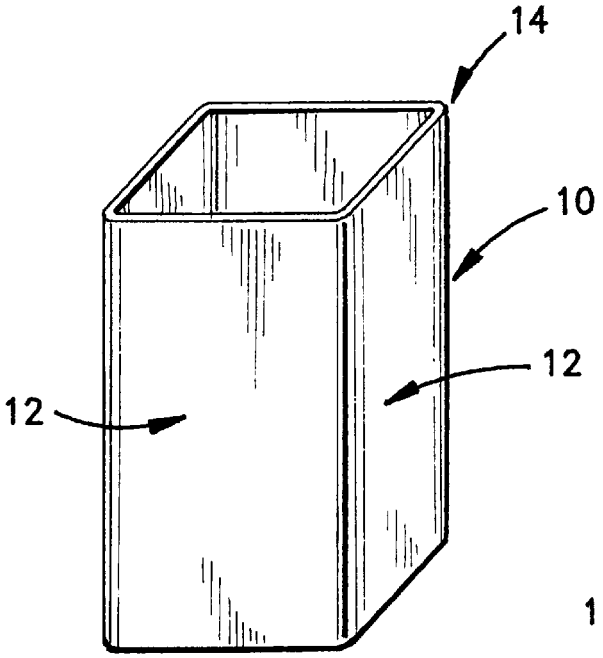
FIG. 1 is a perspective view of a tubular metal body of substantially rectangular cross-section intended for the fabrication according to the invention of a metal package of overall prismatic shape.
Figure 2:
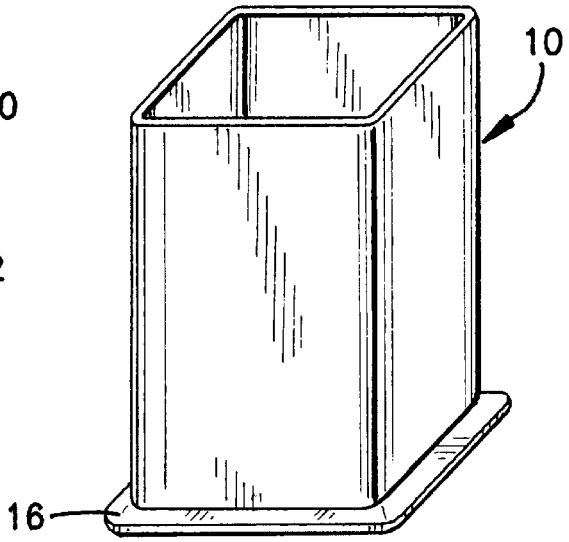
FIG. 2 is a view similar to FIG. 1, in which the tubular body moreover includes a lower flange.

In order to fabricate a metal package of overall prismatic shape according to the invention, a tubular metal body 10 such as represented in FIG. 1 is firstly fabricated.

The body 10 has a substantially rectangular cross-section and is intended to delimit lateral faces 12 of the metal package. The lateral faces 12 are connected together by rounded corners 14.

The tubular body 10 is fabricated in a manner known per se from a sheet metal blank, which is rolled and then welded so as to form a sleeve and finally expanded so as to obtain a substantially rectangular cross-section.

In a conventional manner, the lower end of the body 10 is closed by forming a lower flange 16 on this lower end, and then seaming onto this flange 16 a detached metal face (not represented in the figures) forming the bottom of the package.

The bottom is seamed onto the lower flange either just after forming this flange or later.

Figure 3:
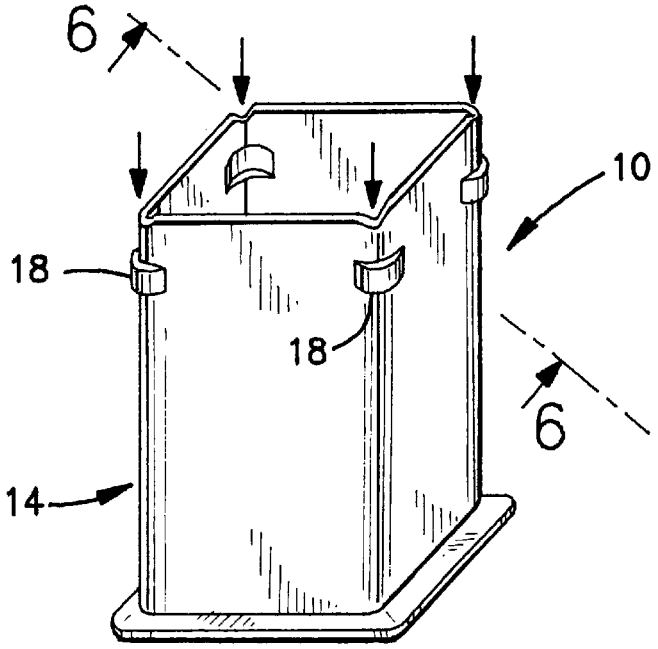
FIG. 3 is a view similar to FIG. 1, in which the tubular body moreover includes metal-expansion beads arranged at the four corners of the body.
Figure 4:
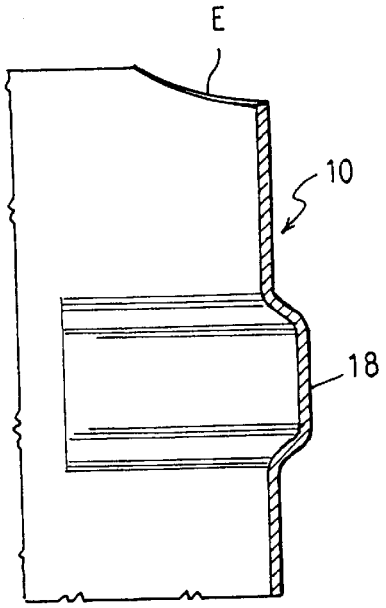
FIG. 4 is a detail view sectioned along a diametral plane of the body representing an expansion bead.
Figure 5:
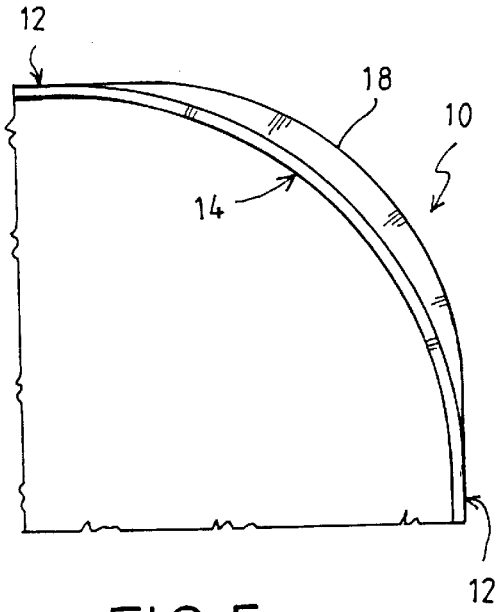
FIG. 5 is a top view of FIG. 4.

Furthermore, as represented in FIGS. 3 to 5, a bead 18 projecting radially outwards from the body, with respect to the longitudinal direction of this body, is formed in proximity to the upper end of the body 10 and in each of the corners 14 of this body.

Figure 9:
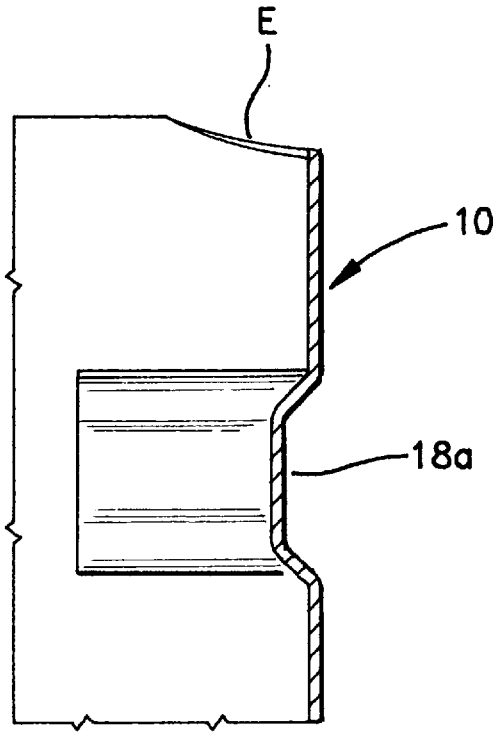
FIG. 9 is a partial view of an alternative embodiment of the bead of the present invention.

As a variant, the beads 18 may run radially inwards from the body such as shown by bead 18*a* in FIG. 9.

It will be noted that the beads 18 are all substantially the same distance from the upper end of the body and have the diametral planes of the body 10 as plane of symmetry.

The beads 18 are formed with the aid of known means in such a way as to run parallel to a transverse plane of the body 10 substantially over the same angular sector as the corresponding rounded corners.

Owing to the expansion of metal resulting from the formation of the beads 18, the outline of the upper end of the body 10 exhibits, at this stage of fabrication of the package, axial depressions level with the corners 14. These depressions are indicated by vertical arrows in FIG. 3. An axial depression E is represented in greater detail in FIG. 4.

Figure 6:
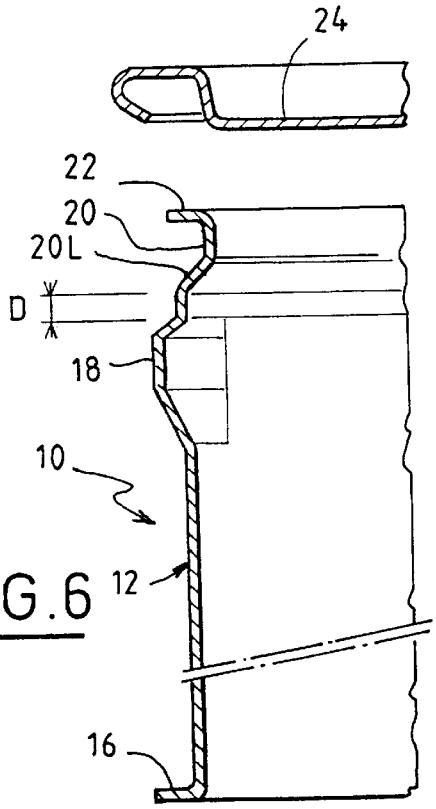
FIG. 6 is a partial view sectioned along the line 6—6 of FIG. 3.

After having formed the beads 18, a neck 20 and an upper flange 22 extending this neck are formed on the upper end of the body 10, with the aid of known means, as is represented in FIG. 6.

The neck 20 is connected to the rest of the body 10 by an inclined linking part 20L. This part 20L is spaced axially a distance D of, preferably, between 0 and 3 mm from the beads 18.

Figure 7:
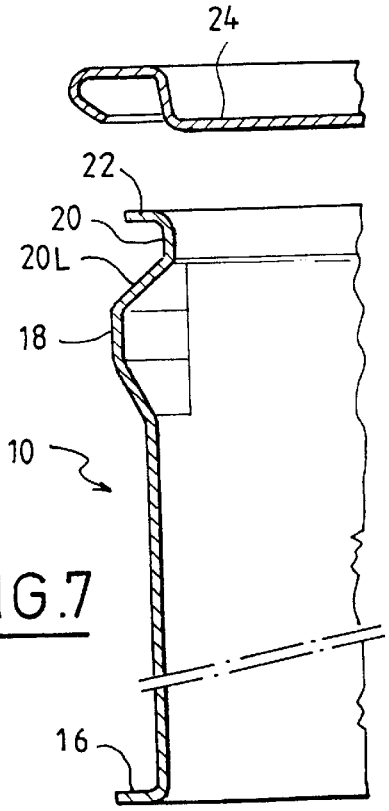
FIG. 7 is a view similar to FIG. 6 showing an embodiment variant of the tubular body.

In the example represented in FIG. 6, the distance D is non-zero, whereas in the variant represented in FIG. 7, the distance D is zero so that the inclined linking part 20L extends the beads 18 directly.

The axial depressions E create deficits of metal making it possible subsequently to offset the surplus of metal appearing at the level of the rounded corners of the body 10 when the neck 20 is formed before forming the upper flange 22. The size of the beads can be easily determined as a function of the surplus of metal which is required to be offset during the formation of the neck followed by the upper flange.

The outline of the flange 22 thus obtained is regular, that is to say its size along a radial direction with respect to the body 10 is substantially identical in the rounded parts and also in the straight parts of the flange.

Figure 8:
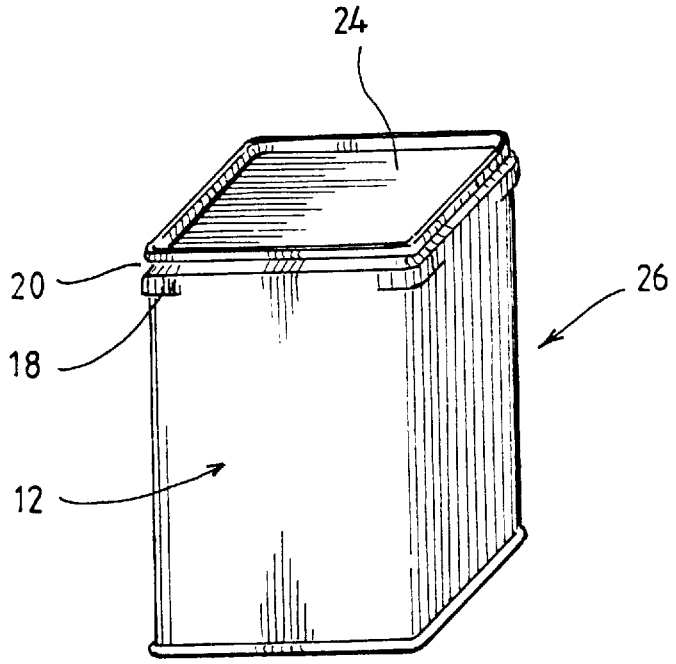
FIG. 8 is a perspective view of a package according to the invention.

Finally, in order to close the upper end of the body 10, a detached metal face 24 intended to form the top of the package is seamed in a manner known per se onto the upper flange 22. A package 26 such as represented in FIG. 8 is thus obtained.

The outline of the upper flange 22 being regular, the top to be seamed can be readily positioned on the flange and the seam obtained subsequently is of very good quality.

The metal packages obtained according to the process of the invention as described above may be easily stacked one above another. Indeed, the lower end of a package can nestle on the necked upper end of another similar package.

The invention is not limited to the exemplary embodiments described above.

In particular, the tubular body can have any substantially polygonal cross-section other than rectangular.

Furthermore, the neck can be formed equally well on the upper or lower end of the package.

I claim:

1. A metal package, comprising:

a tubular metal body (10) of substantially polygonal cross-section with lateral faces (12) which are connected together by rounded corners (14), a necked end with a flange extending therefrom, a metal-expansion bead (18) in proximity to the necked end in each of the corners (14) of the body, each bead being substantially the same distance from the necked end, each bead offsetting a surplus of metal at corresponding corners of the flange caused by formation of the neck, said metal-expansion beads being spaced apart such that a discontinuity exists between each bead; and a face (24) forming a top or bottom of the package seamed onto the necked end.

2. The package according to claim 1 wherein each bead 18 extends radially outwards from the body (10).

3. The package according to claim 1 wherein the neck (20) is connected to the body (10) by an inclined linking part (20L) spaced axially a distance (D) of between 0 and 3 mm from each bead (18).

4. The package of claim 1 wherein said neck comprises an outwardly extended flange to which said face is seamed.

5. A process for fabricating a metal package having a tubular metal body (10) of substantially polygonal cross-section and lateral faces (12) connected together by rounded corners (14), comprising the steps of:

radially projecting a metal-expansion bead (18) in proximity to a first end of the body (10) in each of the corners (14) of the body, each bead being substantially the same distance from the first end;

necking the first end;

extending a flange (22) outwardly from the first necked end of the body (10), each bead offsetting a surplus of metal at corresponding corners of the flange caused by formation of the neck;

said metal-expansion beads being spaced apart such that a discontinuity exist between each bead; and, seaming a detached metal face (24) onto the flange (22).

6. The process according to claim 5 wherein each bead (18) extends radially outwards from body (10).

7. The process according to claim 5 further comprising the step of connecting the necked end to the body (10) with an inclined linking part (20L) spaced axially a distance (D) of between 0 and 3 mm from each bead (18).

8. The process according to claim 5 further comprising the step of forming a second flange (16) at a second end of the body (10), opposite to the first end, and seaming a second detached metal face onto the second flange (16).

9. A metal package comprising:

a tubular metal body of substantially polygonal cross-section with faces connected with rounded corners;

a neck adjacent an end of said body which has a smaller circumference than said body;

a flange extending outwardly from said neck which is adapted to have a face seamed thereto;

an expansion bead in each of said corners adjacent said end which offsets a surplus of metal at corresponding corners of said flange caused by formation of said neck, whereby said flange has a regular outline suitable for seaming a face thereto;

said metal-expansion beads spaced apart such that a discontinuity exist between each bead.

10. The package of claim 9 further comprising a face seamed to said flange.

11. The package of claim 9 further comprising an inclined portion of said body linking said neck to each said bead.

12. The package of claim 11 wherein said inclined portion is separated from each said bead.

13. The package of claim 9 wherein each said bead extends radially outward from said body.

14. The package of claim 9 wherein each said bead extends radially inward from said body.

15. A method of seaming a detached face to an end of a metal package with a tubular metal body of substantially polygonal cross-section with faces connected with rounded corners, comprising the steps of:

expansively forming a bead in each of the corners of the body adjacent the end to which the face is to be seamed;

at the end of the body to which the face is to be seamed, forming a neck which has a smaller circumference than the body;

extending a flange outwardly from the neck, each bead offsetting a surplus of metal at corresponding corners of the flange caused by formation of the neck, whereby the flange is provided with a regular outline suitable for seaming the face thereto;

said metal-expansion beads being spaced apart such that a discontinuity exists between each bead; and seaming the face to the flange.

16. The method of claim 15 further comprising the step of linking the neck to each bead with an inclined portion of the body.

17. The method of claim 15 further comprising the step of extending each bead radially outward from the body.

18. The method of claim 15 further comprising the step of extending each bead radially inward from the body.

* * * * *